United States Patent [19]

Whitten, Jr.

[11] Patent Number: 4,503,295

[45] Date of Patent: Mar. 5, 1985

[54] SPRINKLER CONTROLLER

[75] Inventor: Robert E. L. Whitten, Jr., Dallas, Tex.

[73] Assignee: Telsco Industries, Inc., Dallas, Tex.

[21] Appl. No.: 605,976

[22] Filed: Apr. 30, 1984

Related U.S. Application Data

[63] Continuation of Ser. No. 392,318, Jun. 25, 1982, abandoned.

[51] Int. Cl.[3] ..... H01H 43/00

[52] U.S. Cl. ..... 200/35 R; 200/38 R; 200/38 FB; 200/38 DA

[58] Field of Search ..... 200/16, 24, 27 B, 27 BA, 200/35 R, 38 R, 38 B, 38 BA, 38 C, 38 CA, 38 D, 38 DB, 329, 339; 74/3.52, 125; 137/78.3; 318/443; 239/70; 307/114, 141, 141.8

[56] References Cited

U.S. PATENT DOCUMENTS

| | | | |
|---|---|---|---|
| 2,886,106 | 5/1959 | Gallagher et al. | 200/38 FB |
| 3,012,444 | 12/1961 | Hauser | 74/125 |
| 3,024,372 | 3/1962 | Seele | 307/118 |
| 3,039,698 | 6/1962 | Richards | 137/78.3 |
| 3,040,227 | 6/1962 | Hauser | 318/443 |
| 3,040,228 | 6/1962 | Hauser | 318/443 |
| 3,063,643 | 11/1962 | Roberts | 239/70 |
| 3,123,681 | 3/1964 | Martini | 200/33 R |
| 3,170,330 | 2/1965 | Reinecke | 74/3.52 |
| 3,205,717 | 9/1965 | Alston et al. | 74/3.52 |
| 3,207,866 | 9/1965 | Hicks | 200/38 DB |
| 3,227,821 | 1/1966 | Hauser | 200/11 K |
| 3,231,691 | 1/1966 | Sherman | 200/24 |
| 3,234,410 | 2/1966 | Sherman | 307/141.8 |
| 3,244,912 | 4/1966 | Hauser | 307/141 |
| 3,260,807 | 7/1966 | Rulseh et al. | 200/38 FB |
| 3,522,393 | 7/1970 | Banathy et al. | 200/38 FB |
| 3,577,004 | 5/1971 | Tsoutsas | 307/141 |
| 3,587,329 | 6/1971 | Fleckenstein | 200/38 DA X |
| 3,740,575 | 6/1973 | Bizeoco | 200/38 DA X |
| 3,780,766 | 12/1973 | Link | 137/624.2 |
| 3,864,539 | 2/1975 | Hauser | 200/38 DA |
| 3,886,378 | 5/1975 | Morgan | 307/141.4 |
| 3,911,955 | 10/1975 | Link | 137/624.2 |
| 3,963,884 | 6/1976 | Pollock | 200/16 D |
| 3,987,430 | 10/1976 | Saarem et al. | 340/309.15 |
| 4,029,917 | 6/1977 | Webster | 200/16 D X |

*Primary Examiner*—J. R. Scott

*Attorney, Agent, or Firm*—Richards, Harris, Medlock & Andrews

[57] ABSTRACT

A sprinkler controller includes a station timing dial having a front and back plate with an intermediate plate positioned therebetween. A plurality of switch plates having a tripper arm attached thereto are positioned around the periphery of the dial with each switch plate positioned between the front and back plates. Adjacent switch plates are positioned on opposite sides of the intermediate plates for movement circumferentially about the dial. The switch plates move such that one plate overlies an adjacent plate, thereby permitting the reduction in size of the station timing dial. The controller includes a clock and calendar dial using a plurality of sliders having a toggle portion and a cam portion. The toggle portion and cam portion are connected by a flexible arm which permits the movement of the toggle portion toward the cam portion to facilitate sliding of the slider switches relative to the clock and calendar dials. The sliders engage control switches for operating the controller. The controller permits the dual programming of certain stations permitting certain predetermined stations to be controlled in accordance with an alternate water program.

23 Claims, 13 Drawing Figures

SPRINKLER CONTROLLER

This application is a continuation of application Ser. No. 392,318, filed 6/25/82 now abandoned.

TECHNICAL FIELD

The present invention is to a sprinkler controller and more particularly to a compact controller which provides for automatic or manual control of sprinkler timing segments.

BACKGROUND ART

Most sprinkler control units incorporate a system for controlling a plurality of sprinkler stations for a selected time and a method of controlling such stations on predetermined days and designated times. These functions are usually carried out by a station timing dial, calendar dial and clock dial. Prior units also have provided dedicated stations to be controlled on a different cycle than non-dedicated stations. For example, dedicated stations may be those which supply water to plants or shrubs which need more or less frequent watering than other stations.

The prior art sprinkler controllers include deficiencies in each of these areas of control. In most units, the components making up the individual station timing segments are so large that the number of segments must be limited, generally to six or seven stations. Even with limiting the number of station timing segments, the station dials are generally large. Where as many as ten or eleven station timing segments are provided, the dial size becomes excessive in its size.

In many prior art sprinkler controllers, the station timing dial turns at timing speed only and does not fast index subsequent to completion of its timing cycle. This does not permit skipping stations which are not connected or where the timing segment is set on "0" time. While many prior art units provide for manual operation, the provisions for such operation are in many cases only semiautomatic, while others use a series of separate switches which require additional expense and space requirements.

In most prior art units, the station timing dial provides for very inaccurate setting of the desired operation. In many cases, the force developed from actuated switches or sensors has a tendency to move the timing segment cam or lug out of position and thus change the desired setting.

With respect to the calendar and clock dials used on prior art units, many units incorporate pins for designating desired operation times and dates. These often become loose or lost during use. In some units, screws are required or various cams or gears must be removed and repositioned to change the timing sequence of the controller. Of course, these arrangements require tools and are inconvenient and time consuming to the user. Those prior art devices which require captive pins require additional wasted space in front of the dials to avoid interference with the housing cover or door. In some cases, the force developed from operating switches or sensors has a tendency to move the pin or cam out of position. Further, pins and cams often cannot readily be adapted to more than two positions and thus their incorporation into a design prevents alternate programming or requires more dial components to accomplish alternate or dual programming.

Where such pins or cams are used, the dials required are generally large in diameter or thick in depth. Both of these features result in additional wasted space.

In prior art units which attempt to provide a dual programming function, that is, where certain stations may be operated on a different schedule than others, such units have required that stations be dedicated to an alternate program. This limits the number of stations which can be used for a regular program of watering. In other units, separate switch groups are incorporated to accomplish multiple programming. These introduce additional expense and space requirements. In other prior art units, additional dials are incorporated to accomplish a multiple programming feature. Such arrangements greatly add to production costs and require additional space.

DISCLOSURE OF THE INVENTION

The present sprinkler controller overcomes many of the deficiencies found in prior art units. The present invention incorporates a station timing dial of a relatively small and compact size although providing for numerous station timing segments. This results in space savings, as well as a lower production cost. Indexing between timing segments is fast and stations set to "0" time are skipped without dwell time. The timing segment components are held in position with a detent action and timing control is accurate.

A true manual operation is provided by way of a knob positioned concentric with the station timing dial. The control activates the manually selected station until the unit is turned off by the operator. The concentric positioning feature reduces the components, cost and space required.

The station timing dial is greatly reduced in size by using a plurality of switch control mechanisms spaced around the circumference of the dial. The dial has a front and rear plate interconnected one to the other with an intermediate plate positioned therebetween. A plurality of switch plates having a switch tripper arm attached thereto are positioned around the periphery of the dial with each switch plate positioned between the front and back plates. Adjacent switch plates are positioned on opposite sides of the intermediate plate such that one switch plate is positioned between the front plate and the intermediate plate and an adjacent switch plate is positioned between the intermediate plate and the back plate. Structure is provided for guiding the switch plates as they are moved relative to the dial.

In one embodiment of the invention, this guide structure includes a groove in the front plate for receiving extensions from a cooperating switch plate. The switch plate is movable relative to the dial with the extensions moving in and being guided by the groove. Likewise, the switch plates positioned between the intermediate plate and the back plate are guided by a groove in the back plate for receiving extensions from the switch plates. The switch plates are movable such that the extensions move in and are guided by the groove. The switch plates are moved circumferentially about the dial using pinion gears journaled between the front and back plates. A toothed rack is formed on each switch plate which cooperates with the pinion gear. By rotating the pinion gear, the switch plate is moved and the timing for the particular station associated with the switch plate is varied as desired.

The clock dial is operated by a timer motor and operates as a clock for controlling the time for initiating a watering cycle. Every 24 hours, the clock dial advances the calender dial one day. Both the clock and calendar dials use sliders which are easily finger operated from the front of the dial to cooperate with switches to control the watering sequence. Each slider has a toggle portion which extends outwardly through a slot in the face of the dial. A cam portion extends through a slot in the rear of the dial. The toggle portion and cam portion are connected by a flexible arm which permits the movement of the toggle portion toward the cam portion. The dial has a thickness defined by a wall spacer, and the sliders have spaced extensions extending from the cam portion which ride on the inside surface of the rear face. Similarly, spaced extensions extend from the toggle portion of the slider and slide along the inside surface of the face of the dial. The inside surface of the face of the dial has a plurality of spaced notches which correspond to the extensions from the toggle portion of the slider.

Movement of the slider is easily accomplished by pushing and depressing the toggle portion of the slider to disengage the extensions normally biased against and into the notches in the inside surface of the dial face. The slider may be moved to a desired position for positioning the cam portion relative to a switch which is engaged upon rotation of the dial.

Both the calendar and clock dials are relatively small and compact. The design of the dials and sliders requires very little space in front of the dials. The sliders are easily finger operated and are permanently retained as a component of the dial to avoid loss or inadvertant misplacement. The force developed from operating the clock and calendar switches tends to lock the sliders in detents rather than move them out of position. The sliders may have several positions for alternate programming with little additional space requirement.

In the present invention, a plurality of sliders are positioned around the circumference of both the clock and calendar dials. On the clock dial, these sliders may be set at their inboard position wherein the cam portion does not engage a control switch upon rotation of the dials or to an outboard position wherein the cam portion of the slider engages a switch upon rotation of the dial. With respect to the calendar dial, an intermediate position is provided which permits alternate programming by the engagement of only one switch rather than two cooperating switches when the slider is positioned in its full outboard position.

This arrangement, along with circuit options which will be disclosed, permits multiple programming of any number of stations. Specific stations are not dedicated to an alternate program but may be random or consecutive and may be changed at any time. This arrangement requires few parts and little additional space.

BRIEF DESCRIPTION OF THE DRAWINGS

For a more complete understanding of the present invention and for further details and advantages thereof, reference is now made to the following Detailed Description taken in conjunction with the accompanying Drawings, in which.

DETAILED DESCRIPTION

Figure 1:
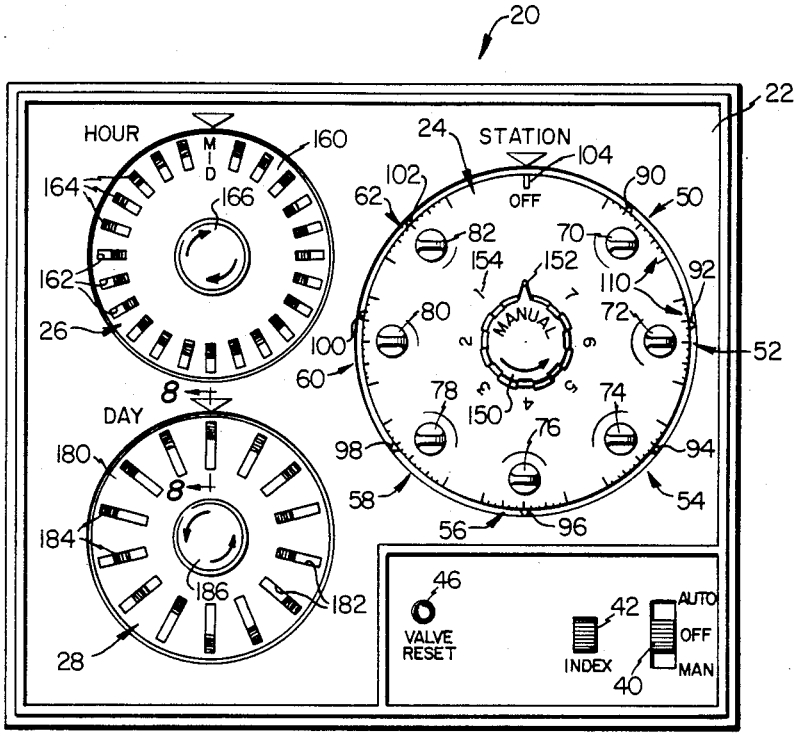
FIG. 1 is a front view of the sprinkler controller of the present invention.

Referring to FIG. 1, a sprinkler controller 20 includes a front face plate 22 with appropriate cutouts for revealing a station timing dial 24, a clock or hour dial 26 and a calendar or day dial 28. Face plate 22 also has appropriate cutouts to reveal a mode (off-manual-automatic) switch 40, an indexing switch 42 and a circuit breaker (valve reset) 46.

In the embodiment shown, station timing dial 24 is designed to control seven stations having seven station controller assemblies 50, 52, 54, 56, 58, 60 and 62 spaced circumferentially about station timing dial 24. Each of these controllers includes a time set knob 70, 72, 74, 76, 78, 80 and 82, respectively, for controlling a tripper arm 90, 92, 94, 96, 98, 100 and 102, respectively. The station timing dial 24 also has an off position shown at 104. Each station controller assembly has a timing scale, as identified at station 1 by the numeral 110, on the face 106 of dial 24. This scale is divided into a range from 0 to 60, indicating the number of minutes the station may be operated.

While the embodiment shown discloses a seven station timer providing a range from 0 to 60 minutes per station, it will be understood that a larger or smaller number of stations can be accommodated, each having a larger or smaller timing scale, without departing from the spirit or scope of the present invention.

As will be discussed hereinafter in greater detail, tripper arms 90 through 102 may be controlled by their respective time set knobs 70 through 82, respectively, to set the desired timing for a particular station by merely rotating the time set knob and aligning the tripper arm with the desired time on the timing scale. A manual control knob 150 is mounted concentric with station timing dial 24. Manual control knob 150 has a pointer 152, which, when aligned with a particular station as identified on the inner scale 154, may be used to manually control that particular station.

Clock dial 26 has a front face 160 with a plurality of slots 162 circumferentially spaced near the outer circumference of the dial. Each slot has an hour identified adjacent thereto to indicate the hour associated with such slot. In the embodiment shown, clock dial 26 is a 24-hour dial and has 23 such slots, a slot not being provided for the midnight hour. A slider 164 extends upwardly through each slot 162 and may be positioned inboard or outboard relative to the slot as will be discussed hereinafter in greater detail. A center knob 166 is provided on clock dial 26 to aid rotation of the dial for setting the time of day.

Calendar dial 28 has a front face 180 also with a plurality of slots 182 circumferentially spaced around the periphery of the dial. In the embodiment shown, there are 14 such slots, representing a two week calendar dial. Each slot is designated with an appropriate letter to indicate a particular day of the week. A slider 184 extends upwardly through each slot 182 and may be positioned in an inboard, outboard or intermediate position as will be discussed hereinafter in greater detail. A center knob 186 is provided on calendar dial 28 to aid rotation of the dial for setting the day of the week.

Figure 2A:
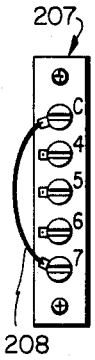
FIG. 2*a* is a rear view of a portion of the controller as seen from along line 2*a*—2*a* of FIG. 2.
Figure 2:
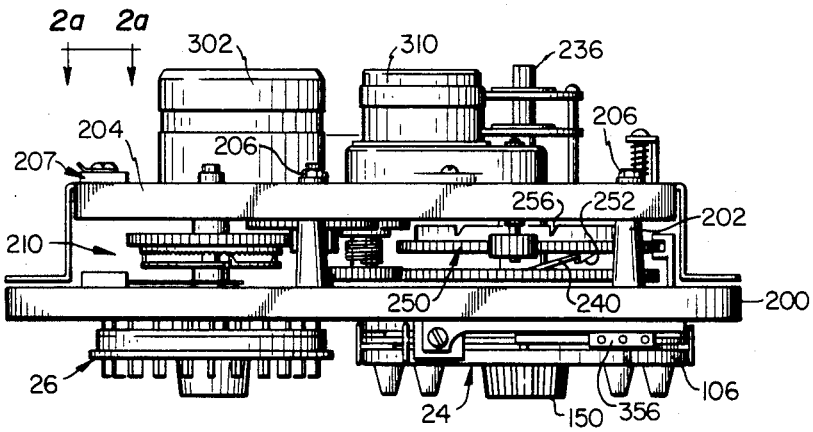
FIG. 2 is a top view of the controller with the front plate removed.
Figure 3:
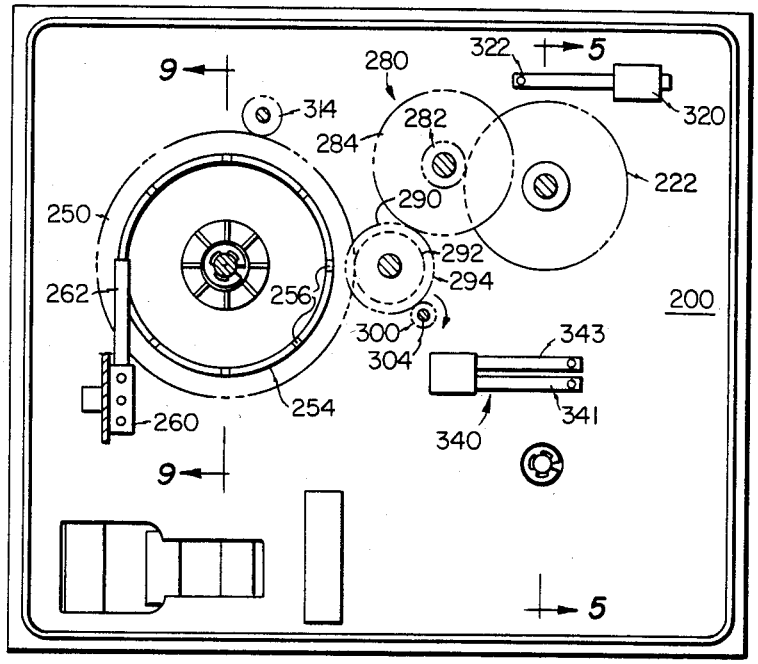
FIG. 3 is a rear view of the controller with the back plate and clock and indexing motors removed.
Figure 4:
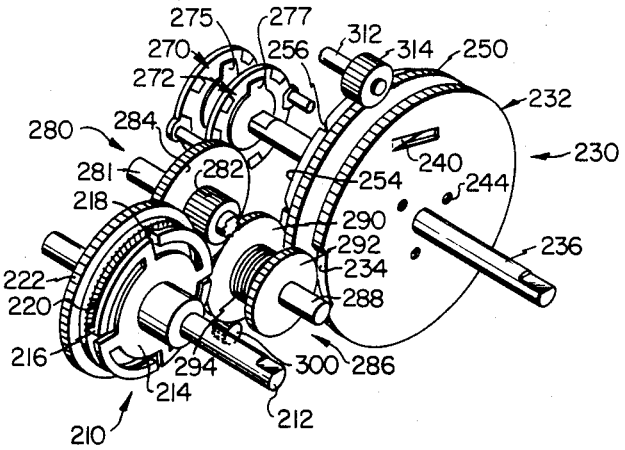
FIG. 4 is a perspective view showing the gear mechanisms of the controller.

Referring to FIGS. 2, 3 and 4, the gear system for the station timing dial and calendar and clock dials is shown in detail. Referring to FIG. 2, the sprinkler controller is shown with the front face plate 22 removed. An intermediate plate 200 has a plurality of positioning legs 202 extending therefrom. A back mount plate 204 is attached to positioning legs 202 by appropriate screws such as screws 206. FIG. 2*a* shows terminal strip 207 mounted on the back face of plate 204. Terminal strip 207 has a common terminal C and terminals corresponding to stations 4 through 7 and is used in the dual programming feature of the present invention as will be described hereinafter in greater detail. FIG. 2*a* shows a jumper wire 208 connected between common terminal C and station terminal 7.

The clock dial gear train 210 includes clock dial 26 (FIG. 2) fixed to a shaft 212 (FIG. 4) with a clutch spider 214 also fixed to shaft 212. Clutch spider 214 has a plurality of arms 216 with engaging fingers 218 on the ends thereof for cooperating with teeth 220 on clock clutch gear 222 which is positioned on but is free to rotate relative to shaft 212. Clutch spider 214 is designed such that it may be moved in a clockwise direction (as viewed from the front of the controller) without movement of clock clutch gear 222. Movement of the clock clutch gear 222 in the clockwise direction (as viewed from the front of the controller) drives the clutch spider and thus drives shaft 212 and clock dial 26.

Still referring to FIGS. 2, 3 and 4, and particularly FIG. 4, station timing dial gear train 230 includes station timing dial 24 which is fixed to a station timing gear 232. Gear 232 has external gear teeth thereon and an idle cutout 234 along one segment of the circumference. Station timing gear 232 and station timing dial 24 are positioned on but not pinned to station timing dial shaft 236.

As is seen in FIG. 2, manual control knob 150 is fixedly attached on one end of shaft 236. Station timing gear 232 has a finger 240 which is attached to and extends in a rearward orientation from station timing gear 232. Holes 244 are for receiving appropriate bolts therethrough to attach station timing gear 232 to station timing dial 24. An indexing gear 250 is positioned immediately behind timing gear 232 on shaft 236 but is not pinned to the shaft. Gear 250 has an upstanding dog 252 extending from the forward face thereof (FIG. 2) and has a rearwardly facing circumferential ring 254 with a plurality of notches 256 on the ring. Notches 256 may be seen in FIGS. 2, 3 and 4. As can be seen in FIG. 3, a switch 260 is positioned with an arm 262 which cooperates with notches 256 in ring 254. Two rotary switches 270 and 272 are mounted relative to the rearward end of shaft 236. Switch 270 includes a stator portion 271 (FIG. 9) having contacts thereon associated with each station and rotor 275 mounted for rotation with shaft 236. Similarly, switch 272 includes a stator portion 273 having contacts thereon associated with the predetermined dual program stations and a rotor 277 mounted for rotation with shaft 236.

Further detail concerning station timing dial gear train 230 is discussed hereinafter with respect to the description of FIG. 9.

Referring still to FIGS. 2, 3 and 4, an intermediate gear train 280 rotates on a shaft 281 and has a smaller first gear 282 which meshes with clock dial timing gear 222. A larger gear 284 engages drive gear assembly 286 on shaft 288. Drive gear assembly 286 includes a larger gear 290 and a smaller gear 292 connected to gear 290 by one way clutch spring 294. As seen in FIG. 3, gear 290 of drive gear assembly 286 is driven by a clock drive gear 300. A clock motor 302 (FIG. 2) drive shaft 304 on which clock drive gear 300 is mounted. As is seen in FIG. 3, clock drive gear rotates in a clockwise direction.

Also shown in FIGS. 2 and 4 is an index motor 310 which drives by way of shaft 312 an index motor gear 314. Index motor gear 314 engages and drives indexing gear 250.

Figure 5:
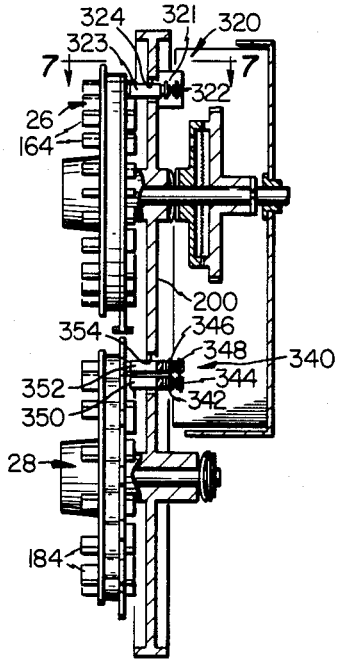
FIG. 5 is a section view taken along line 5—5 of FIG. 3.

Referring to FIGS. 3 and 5, a clock switch 320 is mounted from intermediate plate 200 opposite the position of clock dial 26. Switch 320 has an inner and outer arm 321 and 322, respectively. A floating cam 323 is positioned in a slot 324 through intermediate plate 200. Switch 320 is closed when arm 321 is biased rearwardly into contact with arm 322. This is accomplished by the engagement of cam 323 in response to engagement by slider 164 upon rotation of clock dial 26.

Similarly, a calendar switch 340 is mounted to intermediate plate 200 on the side opposite calendar dial 26. Switch 340 is a dual switch. One portion consists of inner and outer contacts 342 and 344. A second portion has inner and outer contacts 346 and 348, respectively. Floating cams 350 and 352 are positioned through a slot 354 in intermediate plate 200. The first portion of switch 340 is closed through engagement of cam 350 by slider 184 on calendar dial 28. By biasing cam 350 rearwardly, contact 342 is moved into contact with contact 344. Similarly, the second portion of switch 340 may also be closed through engagement of cam 352 through one of the slider 184 to move contact 346 rearwardly into engagement with contact 348.

Referring to FIG. 2, a station switch 356 is mounted to plate 200 above station timing dial 24. Switch 356 is closed upon engagement by tripper arms 90 through 102 as dial 24 is rotated during the automatic operating cycle.

Figure 6:
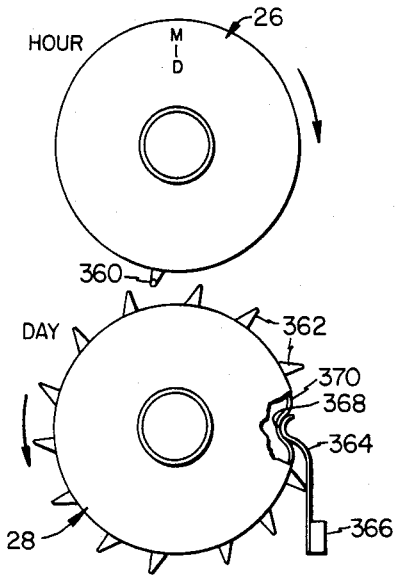
FIG. 6 is a front view showing the clock and calendar dials.

As can be seen in FIG. 6, clock dial 26 has an arm 360 extending substantially radially from one side. Arm 360 cooperates with arms 362 extending radially from and circumferentially spaced around calendar dial 28. During operation, clock dial 26 moves in a clockwise direction while calendar dial 28 moves in a counterclockwise direction as seen from the front of the controller. Upon each revolution of clock dial 26, arm 360 of clock dial 26 engages one of the arms 362 of calendar dial 28 rotating calendar dial 28 one position. Calendar dial 28 is maintained in a designated relationship by spring arm 364 which extends from an appropriate connector 366 from intermediate plate 200. Spring arm 364 has a curved end 368 which is biased against corresponding curved indentions in side wall 370 of calendar dial 28.

Figure 7:
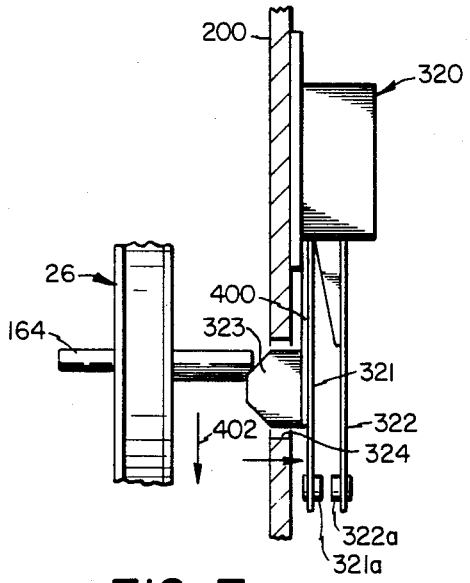
FIG. 7 is an enlarged section view taken along line 7—7 of FIG. 5.

Referring now to FIG. 7, clock switch 320 is shown in enlarged detail. Cam 323 is connected to the base of switch 320 by an arm 400. As clock dial 26 rotates in the direction shown by arrow 402, slider 164 engages cam 323, moving it inwardly against arm 321. In turn, arm 321 moves toward arm 322 causing contact between respective contact plates 321*a* and 322*a* mounted on the ends of switch arms 321 and 322. As slider 164 moves past cam 323, the switch 320 is restored to the open position shown in FIG. 7.

Figure 8:
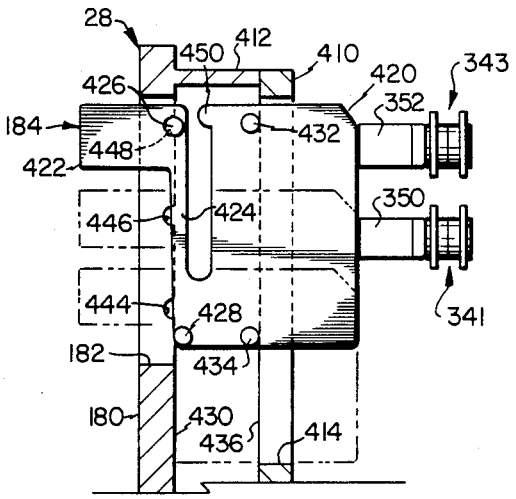
FIG. 8 is an enlarged view of the slider used in both the calendar and clock dials and shows a slider as seen from along line 8—8 of FIG. 1.

FIG. 8 illustrates calendar dial 28 and sliders 184 in enlarged detail. As can be seen in FIG. 8, calendar dial 28 includes a front fact 180, a back wall 410 and a side wall 412 which maintains face 180 in a spaced relationship from back wall 410. Calendar dial 28 is maintained in this assembled arrangement by appropriate screws or other fasteners. Face 180 has a plurality of slots 182 equally spaced in a circumferential arrangement and along a radius of the plate as is shown in FIG. 1. Back wall 410 likewise has a plurality of slots 414 formed therein which correspond to slots 182 but which extend somewhat further toward the center of the dial. Slider 184 includes a switch engaging base 420, a finger engaging toggle 422 connected by relatively thin and somewhat flexible connector arm 424. A pair of upper studs 426 and 428 is formed from both sides of arm 424 for riding against the inside wall 430 of face 180. Similarly, studs 432 and 434 are formed from both sides of base 420 for riding against the inside wall 436 of back wall 410. As can be seen in FIG. 8, three spaced notches 444, 446 and 448 are formed in inside wall 430 of face 180 to cooperate with studs 426 extending from arm 424 of slider 184. By controlling the dimension between studs 426 and 432, and the spacing between face 180 and back wall 410, studs 426 are biased against the inside wall of face 180 and engage notches 448, 446 or 444 when registered thereover. Slider 184 may be easily moved relative to slot 182 and slot 414 in face 180 and back wall 410 by merely depressing toggle 422 and sliding slider 184 inboard or outboard relative to the center of the calendar dial. The engagement of studs 426 in either notches 448, 446 or 444 corresponds to the positions shown in phantom and in solid in FIG. 8. With slider 184 in its radially inboard position, base 420 passes to one side of cams 350 and 352, thereby leaving the switches 341 and 343 open. With the slider 184 in the intermediate position, cam 350 is engaged upon rotation of calendar dial 28 to close switch 341. With the slider 184 in the full outboard position, both cams 350 and 352 are engaged, causing both switches 341 and 343 to be closed. Referring still to FIG. 8, a stop 450 is formed from base 420 immediately below the toggle 422 to prevent overdeflection of toggle 422. This eliminates excessive bending of arm 424 and the possibility of overstressing the arm.

Sliders 164 used with clock dial 26 are of the identical design to sliders 184 used with calendar dial 28. Sliders 164 have only two positions rather than three used with calendar dial 28. These positions are an inboard position wherein the base of the slider passes to one side of cam 323 and therefore does not close switch 320, and an outboard position wherein the base of slider 164 engages cam 323 to close switch 320.

With respect to the sliders 164 and 184, it will be appreciated that the present design provides a very straightforward and dependable switch engaging unit. The design of the part provides an inherent spring feature which positively positions the slider in a designated position without requiring a component separate from the one piece slide unit. Thus, while other devices require the use of a coil or leaf spring, the present invention eliminates this need and accomplishes all the functions described by using a single and inexpensively produced component which is easily positioned and retained within the calendar or clock dial.

Figure 10:
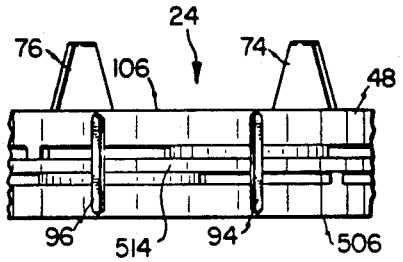
FIG. 10 is a view of the station timing dial switch engaging assemblies as seen from along line 10—10 of FIG. 9.
Figure 9:
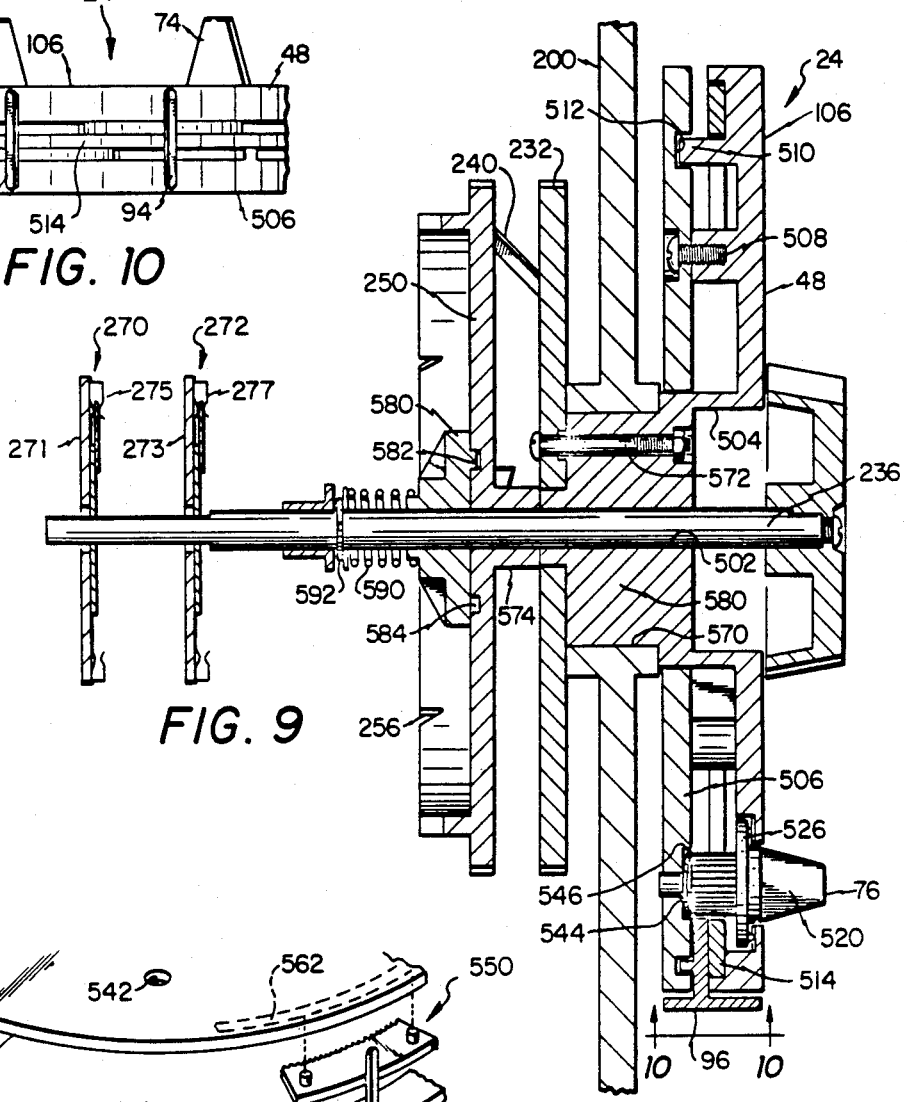
FIG. 9 is a section view taken along line 9—9 of FIG. 3.
Figure 11:
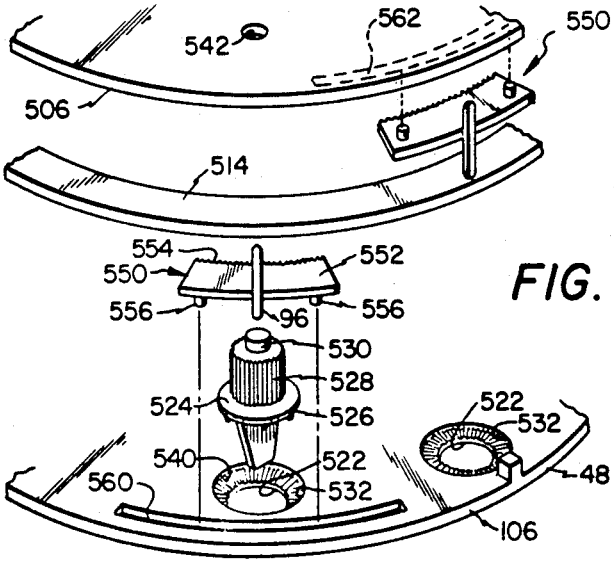
FIG. 11 is an exploded view of the station timing dial switch engaging assemblies and control.

Referring to FIGS. 9, 10 and 11, the station timing dial 24 is shown in enlarged detail. The dial includes face 106 having a central hub 500 with an aperture 502 therein for receiving shaft 236 therethrough. Face 106 also has a circular counterbore 504 concentric with the aperture 502.

A back plate 506 is attached to face 106 by a plurality of screws 508 at spaced points around the circumference of the back plate. One or more alignment studs 510 extend from face 106 for engagement into corresponding notches 512 in back plate 506. An intermediate plate 514 is entrapped between face 106 and back plate 506. As can be seen in FIG. 11, intermediate plate 514 is a ring having an outside diameter equal to the diameter of face 106 and back plate 506. Referring to FIGS. 9, 10 and 11, station timing dial 24 houses seven switch control units. Each of these units includes a time set knob having a head 520 which protrudes through face 106. Knob 76 also includes a circular flange 524 having a plurality of upstanding teeth 526. A pinion gear 528 is formed in line with head 520 and a short shaft 530 extends concentrically from pinion gear 528. The inner surface of face 106 has a counterbore 532 slightly larger than the circumference of circular flange 524 which is received therein. The base of the counterbore has a plurality of indentions 540 for cooperating with teeth 526 for positioning of knob 76. Shaft 530 registers in a corresponding aperture 542 in back plate 506. As can be seen in FIG. 9, a spring washer 544 is positioned in a counterbore 546 in back plate 506 to provide an outwardly directed force against knob 76.

Pinion gear 528 cooperates with a segment gear 550. This structure includes an arcuate plate 552 having a rack 554 on the inboard edge. A pair of protrusions 556 extends from one side of plate 552 for engagement in either groove 560 in face 106 or groove 562 in back plate 506. An upstanding switch tripper arm 96 is attached to plate 552.

As can be seen from the assembly shown in FIG. 9, the rotation of knob 76 causes the translation of segment gear 550 and tripper arm 96 attached thereto about the circumference of station timing dial 24. Tripper arm 96 may be moved relative to a corresponding scale on the front of face 106 to indicate the period for which the particular station control will be operated or turned on.

Referring to FIGS. 10 and 11, it will be seen that adjacent segment gears 550 are positioned on opposite sides of intermediate plate 514. As seen in FIG. 10, this permits the plate to take on an overlying position where one of the units is moved to the extreme left while an adjacent unit is moved to the extreme right position. Such an arrangement permits a wide range of control for tripper arm 96 while permitting the design for station timing dial 24 to be relatively small compared to the number of stations being controlled. Thus, the size of the station timing dial may be reduced significantly while maintaining a sufficient range of control and movement for the tripper arms.

The present invention also is arranged such that each indention corresponds to a 2½ minutes interval of timing. The spring washer 544 urges knob 76 outwardly engaging teeth 526 into the indentions 540 to provide a detenting action and maintain any selected position.

Referring to FIG. 9, hub 500 is mounted through opening 570 in intermediate plate 200. Station timing gear 232 is attached to hub 500 by appropriate bolts 572. Indexing gear 250 is received on shaft 236 behind station timing gear 232 and spaced therefrom by hub 574 extending from indexing gear 250. A clutch plate 580 is slidably keyed to and rides on shaft 236. Clutch plate 580 has a plurality of fingers 582 which extend from the face of clutch plate 580 confronting indexing gear 250 and cooperate with notches 584 in indexing gear 250. When the indexing gear moves in a counterclockwise direction (as seen from the front of the controller), the shaft 236 and clutch plate 580 are rotated counterclockwise (as viewed from the front of the controller). A compression spring 590 is mounted between a stop 592 on shaft 236 and clutch plate 580 to bias the clutch plate against the indexing gear. FIG. 9 also shows rotary switches 270 and 272 mounted relative to the end of shaft 236. The stator portions 271 and 273, respectively, of the switches are fixed relative to the controller housing while the switch rotors 275 and 277 rotate with shaft 236. Switch 272 also incorporates a start circuit switch 272*a*.

The operation of the unit is as follows. When initially programming the controller, the mode switch is placed in the off position to prevent accidental watering. The clock dial is rotated clockwise to set the correct time immediately below the point of the triangular identifier located above the clock dial. The calendar dial is rotated counterclockwise to set the current day immediately below the point of the triangular identifier located above the calendar dial.

The clock dial is set in the following manner. At the hour or hours watering is to commence, the appropriate slide switch 164 corresponding to that hour is moved to the outside end of the slot. All unused slide switches 164 are moved to the "off" position at the inside end of the slot near the center of the dial.

The calendar dial is set in the following manner. For days on which all stations are to be watered, slider 184 on calendar dial 28 is moved to the center of its slot. For the days on which only predetermined stations are to be omitted, such as those which have been alotted to shrubs or other areas which need less frequent watering, the slider is moved to the outboard position. All unused sliders are moved to the "off" position at the inside end of the slots.

The watering time for each station is set by turning the time set knob 76 until the tripper arms are aligned with the required number of minutes indicated on the station timing dial face. The mode switch is then placed on "auto".

Figure 12:
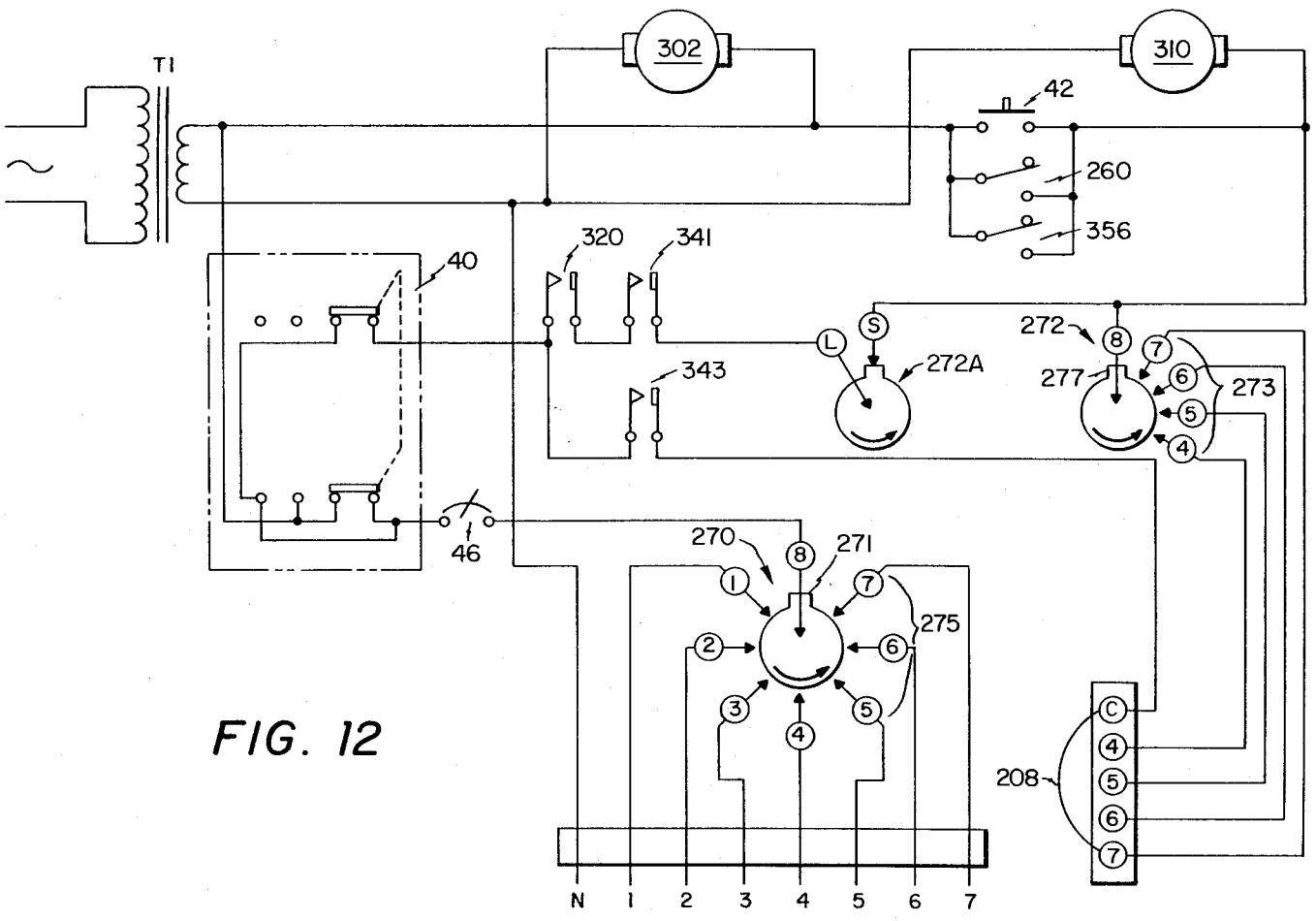
FIG. 12 is a schematic of the electrical circuit used in the present controller.

Referring to FIG. 12, with the mode switch in the "auto" position, power is available at clock switch 320. On the day watering is to occur, the calendar dial closes calendar switch 341. At the hour watering is to start, the clock dial closes clock switch 320. Power is then applied through switches 320, 341 and start circuit switch 272*a* to index motor 310. As shaft 236 initially turns, start circuit switch 272*a* opens and remains open until the entire watering cycle has been completed, thus preventing the start circuit from supplying power to the index motor and interferring with the timing cycle. By the time a normal watering cycle has been completed, clock switch 320 has opened and the controller cannot re-start.

Index motor 310 turns gear 314 which turns indexing gear 250 and one way clutch plate 580. The clutch plate, being pinned to shaft 236, causes the shaft to rotate, thereby rotating selector 277 and selector 275. At the same time, indexing gear 250 drives station timing gear 232 through the engagement of finger 240 by dog 252. The station timing dial 24, which is attached to station timing gear 232, rotates at the same time.

As station timing gear 232 rotates, cutout 234 moves and the overrunning timing clutch gear 292 is engaged. This, in effect, connects the station timing gear 232 with the timing motor system.

Simultaneously, switch 260 is actuated by the ring 254 extending from indexing gear 250 and holds power on the index motor, thereby maintaining rotation to the system. Selector 275 opens, and as arm 262 of cam switch 260 drops into the first notch 256 on ring 254 of indexing gear 250, the index motor stops. This positions the first station dial timing segment at its starting position. Selector 277 distributes the power to the first station at this point.

Clock motor 302 rotates gear 300 (FIG. 3) and station timing dial 24 through gears 290 and 292 by way of one way clutch spring 294 (FIG. 4). During this operation, indexing gear 250, clutch plate 580 and shaft 236 do not rotate during the timing cycle. Rather, station timing gear 232 and station timing dial 24 attached thereto are rotated in a counterclockwise direction as seen from the front of the controller.

When the set time has elapsed, station timing dial 24 has carried tripper arm 90 to engagement with station switch 356 (FIG. 2). Upon engagement with station switch 356, the switch is closed, activating index motor 310. The index motor then drives indexing gear 250, causing switch 260 to activate. Indexing gear 250 continues to rotate and dog 252 picks up finger 240 to rotate station timing gear 232. This in turn causes the rotation of station timing dial 24 and rotors in switches 270 and 272. Tripper arm 92 leaves station switch 356 causing the switch to open. Switch 260, now closed, supplies power to the index motor until the switch falls into the next notch 256 on ring 254 of indexing gear 250, thereby opening switch 260.

The next timing segment on the station timing dial 24 is in its starting position and the timing cycle starts again.

This sequence continues until after time is expired in the last station dial timing segment. Tripper arm 102 on station 7 activates station switch 356, and index motor 310 drives indexing gear 250, closing cam switch 260 to continue the rotation of the indexing gear. The indexing gear picks up station timing gear 232 and continues to rotate the station timing gear with station timing dial 24. Station switch 356 opens, but cam switch 260 contines to supply power to the index motor to rotate indexing gear 250 until the next notch in ring 254 attached to indexing gear 250 is engaged by switch 260.

At this point, clock switch 320 (FIGS. 3 and 5) has opened and the timing clutch gear 292 is registered in the cutout 234 in station timing gear 232. Rotary switches 270 and 272 are opened. The system is "off" and ready for the next automatic start when the clock switch 320 and the calendar switch 340 are closed simultaneously.

The present invention provides for the manual operation of the system in the following way. The mode switch 40 is placed in the manual position. This prevents any interruptions or effects from the automatic start or dual program circuits. The manual control knob 150 is rotated to the desired station number. Because knob 150 is pinned to shaft 236, the shaft rotates and causes clutch plate 580 to rotate with the shaft. Clutch plate 580 detents with the movement of fingers 582 to each notch 584 in indexing gear 250. Indexing gear 250 is held stationary by gear 314 which is driven by the indexing motor. Shaft 236 also turns rotor 277 and rotor 275 so that power is supplied to the selected station circuit. Turning manual knob 150 to the "0" position returns the rotor 277 and rotor 275 to the off position.

It should be recognized that this arrangement is a true manual function and does not engage the timing gear 292 which would cause the station timing dial 24 to be in an automatic timing cycle.

The present invention also permits a dual programming operation which is a variation of the automatic operation. This dual program operation is beneficial where some watering stations require less watering than others. For instance, some plants require watering less often than the lawn areas and are often watered only once a week.

In this program operation, all dials and switches are set for the automatic mode. Valves controlling water to areas which are to be watered less often than others are connected to any of the last four stations. For example, assume that station number 7 is to be watered once each Sunday. At the time of installation, a jumper wire 208 is connected from terminal C to terminal 7 on terminal strip 207. Such a jumper wire 208 is shown in both FIGS. 2*a* and 12. On the calendar dial, the sliders 184 for both Sundays are set in the center position. The days on which the other stations are to water, in addition to Sundays, are set on the calendar dial with the sliders positioned in the outboard position.

Referring to FIG. 12, on days where only stations 1 through 6 are to be watered, the calendar dial slider 184 is in the outboard position and closes both switches 341 and 343. Switch 343 applies power to terminal C and through the jumper wire to terminal 7 which is wired to lug number 7 on rotary switch 272. When station 7 is reached, power is fed through lug 8 to the index motor which causes the station to be skipped. On days when stations 1 through 6 and station 7 are to be watered, the calendar dial slider 184 is in the middle position and switch 343 is open. Therefore, power is not available at terminal 7 and station 7 is not skipped.

Thus, the present invention provides a sprinkler controller using a station timing dial which has segment gears alternated on two levels which allows the gears to overlap and thus permits a large reduction in the dial size. The segment gears used in the present invention are reversible and thus only a single segment gear design is required. While the present invention discloses a timer providing seven stations, it will be understood that a unit having more or less stations can be designed in accordance with the present invention.

The present invention also provides for manual operation which is accomplished by a concentric knob turning a shaft which operates a one way clutch and simultaneously controls a rotary selector switch. This switch supplies power to the various stations. The rotary switch remains on selected stations and the timing motor is not engaged during manual operation as in some other prior art devices.

With respect to the design of the calendar and clock dials, a novel slider is incorporated. The slider is simple and inexpensive to manufacture and operate. In the embodiment disclosed, the top or toggle portion is flexed relative to a bottom or base portion. In the present design, flexing of the top portion adds the additional benefit of permitting the operator to gently push down on the toggle to ease the detent action. A raised pad is positioned below the toggle in the slot between the toggle portion and the base to limit the travel and avoid overstressing of the slider. It will be understood that the present invention may also be practiced by designing the base portion such that it flexes relative to the toggle portion. In both instances, the present invention provides a spring action from a single slider component.

Further, the sliders operate by movement against camming surfaces at right angles to the positioning motion. The force experienced by the cam portion of the slider acts to apply additional force tending to further seat the sliders in their detented position. Thus, this arrangement guarantees that the sliders will stay in position. There is no tendency or force applied against the sliders tending to move them out of position.

The present invention defines the sliders in the calendar dial having three positions and in the clock dial having two positions. The sliders can have any number of positions as required to satisfy a particular use. Moreover, the protrusions designed to guide the sliders as they are moved provide a compact, simple and low cost method for guiding and detenting.

With the present invention's type of oval programming arrangement, any number of stations may be included by use of a terminal strip 207 and rotary switch 272, each with a greater or lesser number of circuits. Operator selection and use are easily controlled by a simple jumper wire and positioning sliders as desired.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A switch control mechanism comprising:

a carrier dial mounted for movement relative to a control switch, said dial comprising a front plate, an intermediate plate and a back plate with one switch plate being positioned between the front plate and intermediate plate and the adjacent switch plates being positioned between the intermediate plate and the back plate;

switch plates spaced around the circumference of said dial and mounted for movement with said dial and having means for engaging the control switch as the carrier dial is moved relative thereto, said switch plates being movable relative to said dial and supported by said dial to permit one plate to move to a position overlying an adjacent switch plate, thereby permitting the reduction in size of the carrier dial while maintaining a predetermined range of movement for the switch plates relative to said dial; and means for guiding said switch plates as said switch plates are moved relative to the dial carrier.

2. The switch control mechanism according to claim 1 wherein said guiding means comprises at least one groove in said front plate for receiving extensions from a cooperating switch plate, said switch plate being movable with said extensions moving in and guided by said groove.

3. The switch control mechanism according to claim 2 wherein said guiding means further comprises at least one groove in said back plate for receiving extensions from one of said switch plates, said switch plate being movable with said extensions moving in and guided by said groove.

4. The switch control mechanism according to claim 1 wherein said means for moving said switch plates comprises:

a pinion gear journaled between said front and back plates;

a toothed rack on each said switch plates cooperating with said pinion gear, whereby said switch plate is moved by rotation of said pinion gear.

5. A switch control mechanism comprising:

a dial having a front plate and a rear plate interconnected one to the other;

a plurality of switch plates spaced around the circumference of said dial and having a switch arm attached thereto, said plates being carried by and adjustably positioned around the periphery of said dial with each switch plate positioned between said front and back plates, such that said adjacent switch plates may be selectively moved to a position overlying an adjacent switch plate thereby permitting said switch plates to have a greater range of movement without interference with adjacent switch plates, means for selectively moving said switch plate to position said switch arm relative to the front plate of said dial; and means for guiding said switch plates as said switch plates are moved relative to said front and rear plates.

6. The switch control mechanism according to claim 5 wherein said means for moving comprises:

a pinion gear journaled between said front plate and back plate;

a toothed rack on each said switch plate cooperating with said pinion gear, whereby said switch plate is moved by rotating said pinion gear, whereby said switch plate is moved by rotating said pinion gear.

7. The switch control mechanism according to claim 6 wherein said switch plates are spaced around the circumference of said dial.

8. The switch control mechanism according to claim 5 wherein said guiding means comprises a groove in said front plate for receiving extensions from a cooperating switch plates, said switch plate being movable with said extensions moving in and guided by said groove.

9. The switch control mechanism according to claim 8 wherein said guiding means further comprises at least one groove in said back plate for receiving extensions from one of said switch plates, said switch plate being movable with said extensions moving in and guided by said groove.

10. A one piece switch actuating mechanism comprising:

a base;

a head;

flexible structure attaching said head to said base, said flexible structure permitting the movement of said head relative to said base;

a carrier housing having a bottom plate for receiving the base for movement relative thereto and a top plate for receiving the head for movement relative thereto;

means for capturing said portion of said head and base between said bottom and top plate, said means normally being biased against said bottom and top plates.

11. The switch actuating mechanism according to claim 10 wherein said flexible structure comprises a resilient arm attached between said base and said head.

12. The switch actuating mechanism according to claim 10 wherein said head protrudes through a slot in said top plate, permitting movement of the head by sliding the head relative to the top plate.

13. The switch actuating mechanism according to claim 10 wherein said base protrudes through a slot in said bottom plate.

14. The switch actuating mechanism according to claim 10 further comprising limit means for limiting the movement of said head relative to said base.

15. The switch actuating mechanism according to claim 10 further comprising spaced extensions protruding from said base for engagement against said bottom plate to position said switch mechanism relative to said top plate.

16. The switch actuating mechanism according to claim 10 further comprising spaced extensions protruding from said head for cooperating with notches in said top plate to facilitate positioning said switch mechanism relative to said top plate.

17. A switch actuating mechanism comprising:

upper and lower carrier plates;

a one-piece slider unit having a head portion connected by a resilient arm to a base portion, said arm permitting the resilient movement of said head relative to said base, said slider unit being guided for movement relative to said carrier plates in a plane substantially aligned with or parallel the plane of resilient movement of said head relative to said base.

18. The switch actuating mechanism according to claim 17 wherein said head protrudes through an upper slot in said upper plate and wherein said base protrudes through a lower slot in said lower plate, and wherein said slider is moved by depressing the head relative to the upper plate and sliding said head parallel to the slot.

19. The switch actuating mechanism according to claim 17 wherein said base protrudes through a slot in said lower plate.

20. The switch actuating mechanism according to claim 17 further comprising limit means for limiting the movement of said head relative to said base.

21. The switch actuating mechanism according to claim 17 further comprising spaced extensions protruding from said head for cooperating with notches in said upper plate to detent said slider relative to said upper plate and whereby said head extensions may be disengaged from the notches by flexing the resilient arm and sliding said slider unit in the same plane.

22. A sprinkler controller comprising:

a three-positioned switch actuating mechanism for control of a plurality of watering stations, said three-position switch actuating mechanism including a watering mode, a non-watering mode and a skip watering mode, the watering mode for actuating the watering stations, the non-watering mode for not actuating the watering stations and the skip watering mode for supplying an actuating signal to a circuit location for selected watering stations to be by-passed; and means for selectively connecting said circuit location to a means for by-passing the said selected watering stations such that when said three-position switch is in the skip watering mode and said connecting means connects said circuit location to said means for by-passing the said selected watering stations, the selected watering stations are by-passed.

23. The sprinkler controller according to claim 22 wherein said means for selectively connecting said circuit location to said means for by-passing said selected watering stations is an externally positioned selectively removable connection.

* * * * *